US006546587B2

(12) United States Patent
Christiansen

(10) Patent No.: US 6,546,587 B2
(45) Date of Patent: Apr. 15, 2003

(54) "YUCKY" WIPE-UP-THE-MESS WAND

(76) Inventor: Lyle J. Christiansen, 701 Imperial Dr., Morris, MN (US) 56267

( * ) Notice: Subject to any disclaimer, the term of this patent is extended or adjusted under 35 U.S.C. 154(b) by 32 days.

(21) Appl. No.: 09/948,376

(22) Filed: Sep. 10, 2001

(65) Prior Publication Data

US 2003/0046781 A1 Mar. 13, 2003

(51) Int. Cl.[7] ..... A47L 13/16
(52) U.S. Cl. ..... 15/231; 15/147.2; 15/209.1
(58) Field of Search ..... 15/147.1, 147.2, 15/209.1, 210.1, 228, 231, 232

(56) References Cited

U.S. PATENT DOCUMENTS 4,075,033 A * 2/1978 Knox et al. ..... 15/210.1 X
4,642,836 A 2/1987 Bokmiller ..... 15/118
5,205,012 A 4/1993 Coley ..... 15/210.1
5,323,507 A * 6/1994 Tosato ..... 15/231
2002/0007527 A1 * 1/2002 Hart ..... 15/210.1 X

* cited by examiner

*Primary Examiner*—Mark Spisich

(57) ABSTRACT

A cleaning wand that enables one to wipe off or wipe up materials such as paint, oil, grease, chemicals, hazardous materials, etc. with a hands-off action. The wand comprises a gripping surface (12) inside the front end of a main body tube (20) that effectively holds a folded center section of a household paper towel or a cloth while being used. A flexible front-end piece (10), comprising a hole through its center, is attached around and flush with the front end of the wand. This flexible piece (triangular) provides resistance to bending so that forceful wiping-up is possible. The wand comprises a built-in plunger (22) that enables a user to push out the used paper towel or cloth. The whole mess is then dropped into a garbage can or pail. All this action is done without getting any of the material on one's hands. In some cases serious injury could be prevented.

6 Claims, 1 Drawing Sheet

"YUCKY" WIPE-UP-THE-MESS WAND

CROSS-REFERENCE TO RELATED APPLICATIONS

Not applicable

BACKGROUND—Field of the Invention

Figure 1:
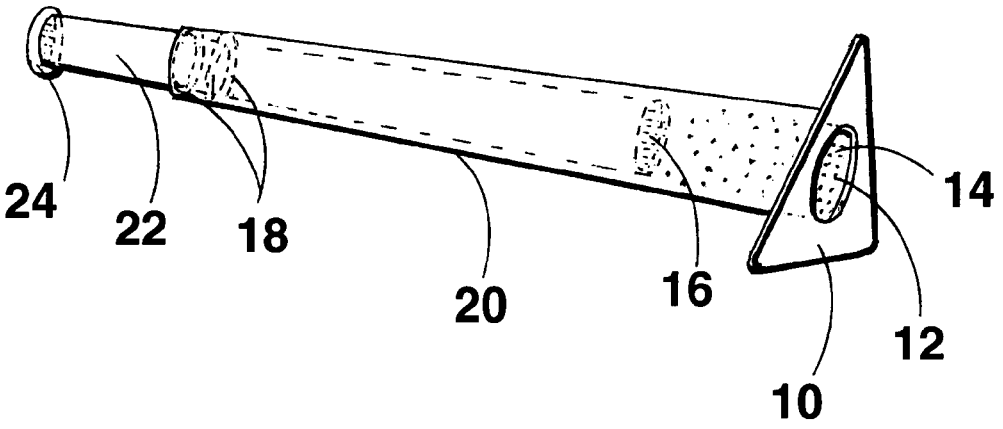

This invention relates to wipe-up-the-mess tools specifically to those tools which include the use of paper towels in its operation and a hands-off-the-mess design.

BACKGROUND—Description of Prior Art

Almost everyone has "yucky" messes to clean up sometimes. A paper towel is handy to grab and wipe-up the mess but somehow, no matter how careful one is the "yucky" gets on one's hands. If it's paint, then one has another problem. One has to wash the hands in paint thinner, soap and water, and sometimes both. A more serious result happens when one wipes up dangerous chemicals or hazardous materials. When this gets on the hands, serious injury can result. One can put on gloves before wiping up these "yucky" messes but one seldom does and even if one does the mess gets on the gloves and then one has to clean off the gloves. Sometimes they are ruined by chemicals or what not. This wand would be very good for wiping up contaminates and infected materials in hospitals.

OBJECTS AND ADVANTAGES

Accordingly, besides the objects and advantages of a "yucky" wipe-up-the-mess wand described above, other objects and advantages are:

(a) to provide a one-piece wand for wipe-up-the-mess cleaning, using common household paper towels.

(b) to provide a one-piece wand for wipe-up-the-mess cleaning that comprises a built-in plunger with a closed front end that enables one to push a used "yuckied" towel out of the wand and into the garbage without getting the "yucky" on one's hands.

(c) to provide a tool that comprises a gripping surface on the inside of the wand's front end. Said gripping surface effectively holds in the stuffed in center of the paper towel while wiping up messes.

(d) to provide a tool that comprises a flexible piece of material (a triangular-shaped piece works good) with a hole through its center and said flexible piece is attached around and flush with the front end of the wand, a paper towel is draped over the triangular piece when one cleans with the wand allowing one to clean out corners, ridges, etc.

Further objects and advantages are: to provide a wipe-up-the-mess wand that is simple to use, uses expensive household paper towels, and which is inexpensive to manufacture.

DRAWING FIGURES

There is one drawing.

FIG. 1 shows a perspective view of a "yucky" wipe-up-the-mess wand.

REFERENCE NUMERALS IN DRAWINGS

10 flexible end piece
12 inside gripping surface
14 middle of paper towel stuffed in here
16 pushing-end
18 ridge
20 main body tube
22 plunger
24 removable snap-on back plate

SUMMARY

In accordance with the present invention, a wipe-up-the-mess wand comprises:

a main body tube with a gripping surface around the inside of its front end;

a piece of flexible material with a hole through its center which is attached around and flush with the front end of the wand;

and a plunger that is built into the wand's main body tube.

DESCRIPTION—FIG. 1—Preferred Embodiment

A preferred embodiment of a "yucky" wipe-up-the-mess wand is illustrated in FIG. 1 (perspective view). The main body 20 of said wand comprises a tube constructed of a plastic material with a diameter of less than 1¼" and not over one foot in length. The folded middle of a household paper towel or a cloth 14 is accepted into the front end of the wand.

A gripping surface 12 that is not over 1½" in length is located around the inside of the front end of the wand's main body tube.

A flexible piece 10 of material with a hole through its center is attached around and flush with the front end of the wand.

A plunger 22 that is of a size to slide within the wand's main body tube extends for the full length of the wand. A pushing end 16 of the plunger is located on the front end of said plunger. A removable snap-on end 24 is located on the back end of the plunger.

Ridges 18 are located around the inside of the back end of the main body tube and around the outside of the plunger located not over 1½" from the back end of the plunger.

FIG. 1—Additional Embodiments

For some clean-up jobs other materials may be preferred instead of paper towels such as cloth for watery messes.

FIG. 1—Alternative Embodiments

Shapes other than triangular could be used for the flexible material that is located on the front end of the wand's main body tube.

Advantages

From the description above, an advantage of a "yucky" wipe-up-the-mess wand becomes evident:

(a) it provides a cleaning tool that allows one to keep one's hands clean or from receiving chemical injuries.

(b) it saves time and expense in cleaning.

Operation—FIG. 1

The manner of using a "yucky" wipe-up-the-mess wand is: one twists and folds the middle of a household paper towel or a cloth 14 and stuffs it down into the front end of said wand. A gripping surface 12, which is similar to the surface of sandpaper, which is located around the inside of the front end of a main tube's body 20 effectively holds the paper towel in position while one wipes up messes.

A flexible end piece 10 that has a hole through its center is attached around and flush with the front end of the wand's main tube. Said end piece spreads out the paper towel and enables one to clean in corners, ridges, etc. and is constructed of a material that provides resistance to bending, therefore forceful wiping up of messes is possible. To remove a paper towel that has been used, one holds the wand over a garbage can and pushes the used paper towel out with the plunger 22. A ridge 18 around the inside of the back end of the wand's main body tube 20 and ridge around the outside of the plunger restricts the plunger from exiting the wand's main body tube backwards. A removable snap-on end 24 that is attached to the back end of the plunger is larger than the plunger; therefore it restricts the plunger from exiting the wand's main body tube frontwards. The plunger's front end is closed and serves as a pushing end 16 to push out a used paper towel.

CONCLUSION, RAMIFICATIONS, AND SCOPE

Accordingly, the reader will see that a "yucky" wipe-up-the-mess wand would be a very handy tool to wipe up "yucky" messes and other messes also.

It permits one to clean up messes using paper towels or cloths without getting the "yucky" stuff on one's hands. This could prevent injury to the hands.

It saves time, energy, and expense in wiping-up-the-mess jobs.

Although the description above contains many specifics, these should not be construed as limiting the scope of the invention but as merely providing illustrations of some of the present embodiments of this invention. For example, other tube shapes for the wand's body could be used and instead of a built-in plunger a simple carry-along plunger could be used but this would less handy.

Thus the cope of the invention should be determined by the appended claims and their legal equivalents, rather than by the examples given.

I claim:

1. A cleaning wand comprising, in combination:

an absorbent cleaning sheet;

a tubular main body having first and second ends, the inner surface of the main body having a means to grip the cleaning sheet when it is inserted into the first end of the main body, the main body including a ridge extending around the inner surface thereof adjacent the second end;

a flexible planar body including a central aperture and which is attached to and flush with the first end of the main body such that the aperture is aligned with the opening at the first end of the main body;

an elongated plunger having first and second ends and being movable along the length of the main body, the first end of the plunger defining a pushing end for ejecting the cleaning sheet when a cleaning operation is complete, the second end of the plunger including a plate for limiting movement of the plunger toward the first end of the main body, the plunger further including a ridge extending around the outer surface and intermediate the ends thereof and which cooperates with the ridge of the main body to restrict movement of the plunger in a direction toward the second end of the main body.

2. The cleaning wand of claim 1 wherein the main body has a diameter of less than 1¼" and the cleaning sheet is one of a paper towel and a cloth, with the cleaning sheet being folded and twisted in a middle thereof prior to insertion into the first end of the main body.

3. The cleaning wand of claim 1 wherein the flexible planar body is triangular in shape.

4. The cleaning wand of claim 1 wherein sheet gripping means extends a distance not more than 1½" in length and the gripping means is comprised of an abrasive surface.

5. The cleaning wand of claim 1 wherein the length of the plunger is approximately the same as the main body.

6. The cleaning wand of claim 1 wherein the plate at the second end of the plunger is secured with a snap flit and which has a diameter larger than that of the plunger.

* * * * *